United States Patent [19]

Morud et al.

[11] 4,304,050

[45] Dec. 8, 1981

[54] METHOD FOR DRYING CHEMICAL OR SEMICHEMICAL WOOD PULP

[75] Inventors: Birger Morud; Leiv Lunde; Ketil Hasvold, all of Sarpsborg, Norway

[73] Assignee: Borregaard Industries Limited, Norway

[21] Appl. No.: 62,472

[22] Filed: Jul. 31, 1979

[30] Foreign Application Priority Data

Aug. 8, 1978 [NO] Norway ..... 782859

[51] Int. Cl.[3] ..... F26B 7/00; F26B 5/04

[52] U.S. Cl. ..... 34/12; 34/15; 34/16; 34/17; 34/18

[58] Field of Search ..... 34/12, 15, 16, 17, 18; 162/71

[56] References Cited

U.S. PATENT DOCUMENTS

| | | | |
|---|---|---|---|
| 1,975,708 | 10/1934 | Bleibler | 34/12 X |
| 2,974,420 | 3/1961 | Kearton et al. | 34/12 X |
| 4,055,903 | 11/1977 | Hansen et al. | 34/12 |

*Primary Examiner*—John J. Camby

*Attorney, Agent, or Firm*—Holman & Stern

[57] ABSTRACT

The present invention provides a method for drying chemical and semi-chemical pulp, especially short-fibred sulphate and sulphite pulp, for obtaining a pulp having a low content of fibre nodules, characterized in that said pulp is dried in a first drying step, whereafter said pulp is reslushed in water, if desired bleached, then dewatered and flash dried in a second step.

6 Claims, 1 Drawing Figure

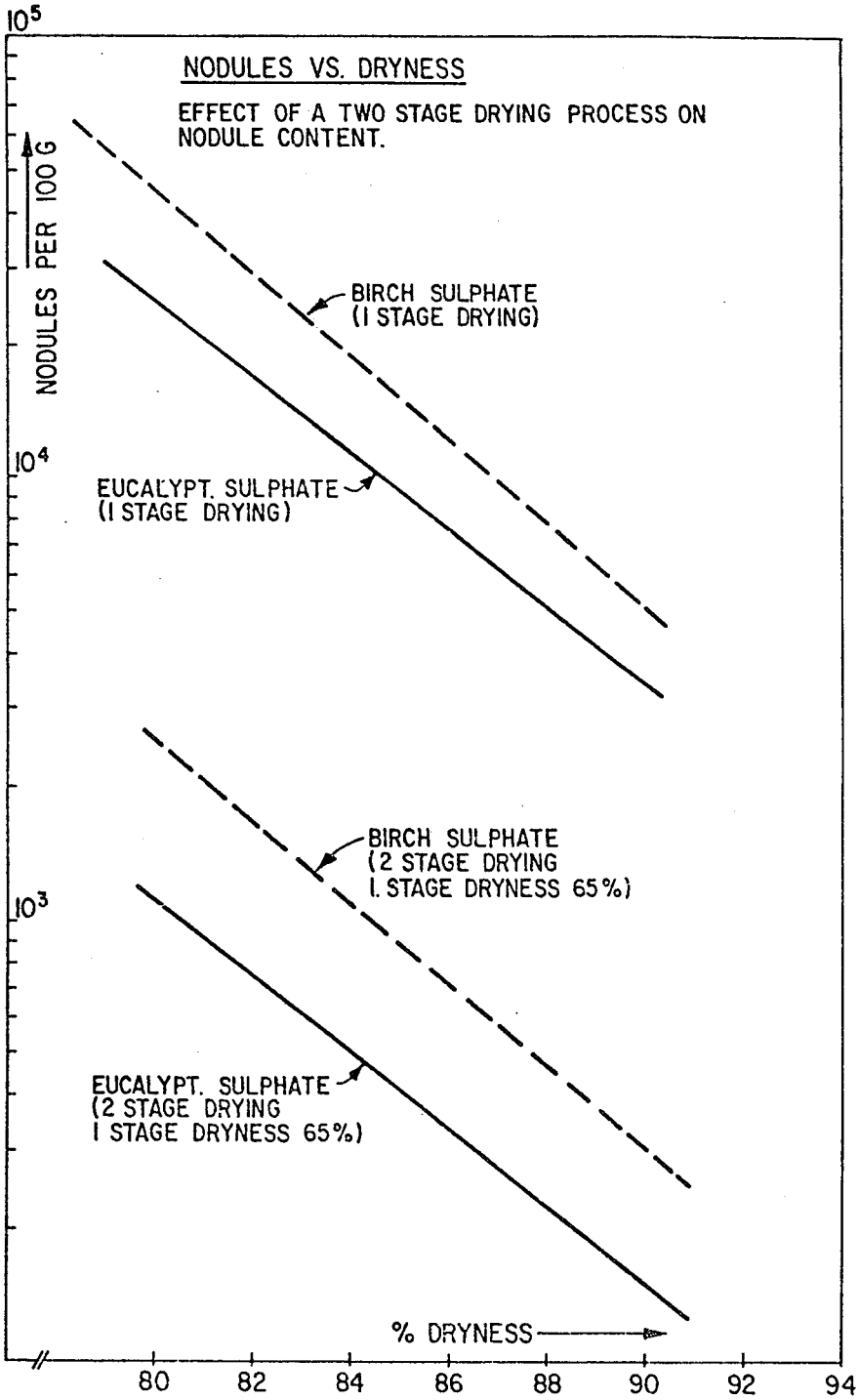
NODULES VS. DRYNESS
EFFECT OF A TWO STAGE DRYING PROCESS ON NODULE CONTENT.
NODULES PER 100 G
$10^5$
$10^4$
$10^3$
BIRCH SULPHATE (I STAGE DRYING)
EUCALYPT. SULPHATE (I STAGE DRYING)
BIRCH SULPHATE (2 STAGE DRYING I. STAGE DRYNESS 65%)
EUCALYPT. SULPHATE (2 STAGE DRYING I STAGE DRYNESS 65%)
% DRYNESS
80
82
84
86
88
90
92
94

METHOD FOR DRYING CHEMICAL OR SEMICHEMICAL WOOD PULP

The present invention relates to a method for flash-drying unbleached as well as bleached chemical or semi-chemical pulp, which is characterized by a relatively low content of fibre nodules.

Known methods for drying cellulose have primarily depended on the nature of the pulp to be treated. Chemical pulp is dried as a continuous pulp web either over steam heated drying cylinders or by the aid of circulated hot air. In this manner a pulp with a dry content of approximately 90% is obtained. This drying method, however, is not suited for mechanical pulp because of partial hornyfication of the hemi-cellulose in the pulp. Such partial hornyfication limits the utilizability of the pulp, e.g. for the production of paper.

Mechanical pulp was previously only dewatered by pressing. In this manner a relatively low pulp having a dry content of approximately 50% was achieved. Lately, a drying process has been developed, the so called flash-drying process, the main object of which is to solve the problems encountered in drying mechanical pulp. With said drying process it is possible to obtain a mechanical pulp having a dry content of approx. 90% without any partial hornyfication of the hemicellulose of the pulp.

Flash drying of mechanical pulp proved to be an advantageous process both economically and technically, and soon said process was also used for drying chemical and semi-chemical pulp. Said process, however, was found to have the disadvantage that it forms varying amounts of fibre nodules which are difficult to disintegrate and in turn result in the formation of so called fish-eyes in paper producted from pulp treated in said manner. In particular, flash drying of bleached short-fibred sulphate and sulphite pulp resulted in problems of the above mentioned nature. Among those skilled in the art much research work has been done to solve said problems. In this regard, reference may be made to: N. Heldal jr., Paper Technology, No. 3, 1964, 241 H-E Engström, O. B. Hovstad and L. Ivnäs, Pulp & Paper, Aug. 28, 1967, 24. Attempts also were made to solve the problems by chemical preliminary treatment of the pulp. Said chemical treatment was mainly limited to the adjustment of the pH of the pulp into the region of 6–7. Furthermore, alternative technical methods connected with dewatering and fluffing have been tried. Said latter attempts were based on the presumption that the dewatering stage as well as the fluffing stage influence the amount of fibre nodules to a considerable degree. These various attempts thus made to solve the problems of fibre nodules have not been successful especially for pulps susceptible to nodule formation such as bleached short-fibred sulphate and sulphite pulp.

It is an object of the present invention to provide a method to flash dry chemical and semi-chemical pulp, preferably bleached short-fibred sulphate and sulphite pulp, where the problems of fibre nodule formation are eliminated.

Said object has been achieved with the method according to the present invention. Said method is essentially characterized in that pulp, in a condition prevalent after digestion and screening is subjected to a two-step drying process, whereby said pulp, in the first step, is dewatered in a conventional manner and then dried to preferably 60% or more dry content, whereupon said pulp after reslushing in water is dewatered and flash dried in a second step.

If an optional bleaching treatment of pulp previously dried is performed, improved dewatering on the bleaching filters and thus a higher dry content is achieved as compared to pulp not previously dried. It should be mentioned that a normal dry content of pulp not previously dried is 11–13% after the filter, whereas the dry content of a pulp which has been previously dried is approximately 15–18%. In some cases even a dry content of up to 25% has been achieved without the use of an egoutteur press on the filter drum.

The extraordinary result is that the problem of nodule content is solved to such a degree of perfection that pulp processed by the method according to the present invention contains so few fibre nodules that it is well suited as raw material even for the most demanding low weight supercalandered papers.

The present invention and its advantages will be illustrated by the following example.

Example

Experiments were performed using two different chemical wood pulps, namely sulphate pulp from eucalyptus and birch. Said pulps were processed by the method according to the present invention in a series of experiments. The pulp was thus dewatered and dried to a dry content of approx. 65% in a first step. Then said pulp was reslushed in water, then dewatered to a dry content of approx. 50% followed by flash-drying in a second step to a dry content varying from approx. 83 to 92%.

For comparison the same pulps were processed in an conventional manner, i.e. in a one-step drying process to give dry contents of approx. 83 to 92%.

The number of fibre nodules in the products were determined according to the SUND-SCA-method, which method i.a. is described by H-E. Engström et al. in Pulp & Paper, August 21, 1967, 30. According to said method a certain amount of pulp is disintegrated in water under standarized disintegration conditions as regards time, temperature and apparatus. After disintegration laboratory sheets are made from said pulp and the number of fibre nodules per 100 grams of pulp is determined.

The results will appear from the accompanying figure. The ordinate shows the number of nodules in a logarithmic scale and the abscissa shows the dry content of the pulp.

As seen from the figure a substantially lower nodule number was achieved by the two-step drying process compared to the conventional one-step drying process. The eucalyptus-sulphate-pulp dried to a 65% dry content in the first step, reslushed in water, dewatered and then dried to a 90% dry content, shows a nodule number of about 100 as compared with a nodule number of approx. 3500 for the corresponding pulp dried only once and with the same dry content. For birch sulphate the corresponding nodule number was approx. 300 after two-step drying and 5000 after the conventional one-step drying.

I claim:

1. A method for drying chemical and semi-chemical pulp, especially short-fibred sulphate and sulphite pulp, to obtain a pulp having a low content of fiber nodules, comprising:

(a) drying the pulp in a first drying step;

(b) reslushing the pulp in water;

(c) dewatering the pulp; and (d) flash-drying the pulp in a second drying step.

2. The method of claim 1 wherein the pulp is bleached after reslushing and prior to dewatering.

3. The method of claim 1 wherein in the first drying step, the pulp is dried to a dry content of at least 60%.

4. The method of claim 1 wherein after the second drying step the pulp has a dry content of from about 83 to about 92%.

5. The method of claims 1, 2, 3 or 4 wherein the first step is performed by flash-drying.

6. The method of claim 1 wherein:

(a) the first drying step comprises dewatering and drying to a dry content of about 65%;

(b) the dewatering step comprises dewatering to a dry content of about 50%; and (c) the second drying step comprises flash-drying until the dry content is from about 83 to 92%.

* * * * *